US008439587B2

(12) United States Patent
Okabe

(10) Patent No.: US 8,439,587 B2
(45) Date of Patent: May 14, 2013

(54) JOINING MEMBER AND BALLPOINT PEN EMPLOYING THE SAME

(75) Inventor: Tomooki Okabe, Tokyo (JP)

(73) Assignee: Zebra Co., Ltd., Tokyo (JP)

( * ) Notice: Subject to any disclaimer, the term of this patent is extended or adjusted under 35 U.S.C. 154(b) by 540 days.

(21) Appl. No.: 12/600,599

(22) PCT Filed: May 23, 2007

(86) PCT No.: PCT/JP2007/060534
§ 371 (c)(1),
(2), (4) Date: Dec. 28, 2009

(87) PCT Pub. No.: WO2008/142787
PCT Pub. Date: Nov. 27, 2008

(65) Prior Publication Data

US 2010/0129136 A1 May 27, 2010

(51) Int. Cl.
*B43K 7/00* (2006.01)
*B43K 5/00* (2006.01)

(52) U.S. Cl.
USPC ..... 401/216; 401/209; 401/212; 401/221

(58) Field of Classification Search ..... 401/221–257, 401/216
See application file for complete search history.

(56) References Cited

U.S. PATENT DOCUMENTS 6,010,269 A * 1/2000 Yokosuka et al. ..... 401/217

FOREIGN PATENT DOCUMENTS

| | | |
|---|---|---|
| JP | 9-85160 | 3/1997 |
| JP | 2004-66478 | 3/2004 |
| JP | 2005-153497 | 6/2005 |
| JP | 2005-288863 | 10/2005 |
| JP | 2005-288864 | 10/2005 |
| JP | 2007-30374 | 2/2007 |
| JP | 2007-98718 | 4/2007 |

OTHER PUBLICATIONS

Translation of JP2007030374 (Feb. 2007).*
EP Search Report dated Oct. 19, 2011, directed to EP Application No. 07743968.5; 5 pages.
International Search Report mailed Jun. 19, 2007, directed to International Application No. PCT/JP2007/060534; 1 page.

* cited by examiner

*Primary Examiner* — Gregory Huson
*Assistant Examiner* — Joshua Wiljanen
(74) *Attorney, Agent, or Firm* — Morrison & Foerster LLP

(57) ABSTRACT

The present invention provides a joining member for connecting an ink accommodating member and a ballpoint pen tip provided in a ballpoint pen, the joining member comprising, as a constituent material, a resin comprising a copolymer of polyethylene terephthalate and polyethylene naphthalate. By this means, it is possible to provide a joining member for a ballpoint pen having, in particular, both sufficiently excellent transparency and gas barrier properties.

1 Claim, 5 Drawing Sheets

JOINING MEMBER AND BALLPOINT PEN EMPLOYING THE SAME

TECHNICAL FIELD

The present invention relates to a joining member, and to a ballpoint pen employing such a joining member.

BACKGROUND ART

In the prior art, as the joining member for connecting the ink accommodating member and ballpoint pen tip provided in a ballpoint pen, joining members such as those disclosed in Patent References 1 and 2 have been known. In Patent Reference 1, a breechblock (joining member) which is an injection-molded part of polybutylene terephthalate (hereafter "PBT") resin is proposed. According to this Patent Reference 1, by using the above-described PBT, there is no cracking or splitting due to stresses in pressure-fit connection, nor is there deformation in elevated-temperature environments, and penetration of gas molecules is suppressed.

Further, a joining member (pen tip holder) disclosed in Patent Reference 2 is molded from polyethylene naphthalate resin. According to this Patent Reference 2, the above joining member of course has transparency, but also has excellent heat resistance and shock resistance, adequately prevents ink evaporation and leakage, and gives no cause for concern of any detriment to functions as a writing instrument or application instrument.

[Patent Reference 1] Japanese Unexamined Patent Publication No. 2005-288863

[Patent Reference 2] Japanese Unexamined Patent Publication No. 9-85160

DISCLOSURE OF THE INVENTION

Problem To Be Solved By the Invention

However, when the inventors studied in detail the joining member disclosed in Patent Reference 1, it was found that the joining member proposed in Patent Reference 1 does not have adequate transparency, and that characteristics to prevent water vapor penetration (hereafter called "water vapor barrier properties") are not necessarily excellent. When transparency in a joining member is not adequate, it is difficult to confirm the small amount of remaining ink, and moreover it is difficult to design various external appearances. Moreover, when the water vapor barrier properties of the joining member are not excellent, water comprised by the ink evaporates to the outside from the joining member, so that the ink viscosity rises and other problems occur.

Further, as a result of studies by the inventors of the joining member disclosed in Patent Reference 2, it became clear that the joining member disclosed in Patent Reference 2 does not have excellent moldability. A joining member connects an ink accommodating tube and a ballpoint pen tip of smaller diameter than that, and so the shape is complex compared with the ink accommodating tube. For this reason, a joining member such as that disclosed in Patent Reference 2 which does not have excellent moldability will undergo a whitening phenomenon upon molding. As a result, not only is transparency of the joining member inferior, but mechanical strength also cannot be described as adequate.

However, the ink which fills the ink accommodating tube is necessarily discharged from the extremity of the ballpoint pen tip via the space inside the joining member. Further, as stated above, the shape of the joining member is more complex than that of the ink accommodating tube, and moreover the area of contact with the ink per unit volume of ink is greater. From these facts, the effect of the joining member on the various characteristics of the ink is greater than that of the ink accommodating tube. Hence in order to suppress degradation of the various characteristics of the discharged ink, the joining member is required to have excellent gas barrier properties, which are characteristics for preventing gas penetration from the inside to the outside or from the outside to the inside.

The present invention was devised in light of the above, and its object is to provide a joining member for a ballpoint pen having, in particular, both sufficiently excellent transparency and gas barrier properties, as well as a ballpoint pen employing such a joining member.

Means For Solving the Problem

In order to attain the above object, the present invention provides a joining member for connecting an ink accommodating member and a ballpoint pen tip provided in a ballpoint pen, the joining member comprising, as a constituent material, a resin comprising a copolymer of polyethylene terephthalate (hereafter "PET") and polyethylene naphthalate (hereafter "PEN").

A joining member of the present invention has both sufficiently excellent transparency and sufficiently excellent gas barrier properties. The reason for this has not been clarified in detail, but the inventors regard the reason to be as follows. PEN is a resin with high crystallinity, and the joining member has a complex shape. Hence upon molding a joining member by injection molding or other means using a resin material comprising only PEN, in portions of high fluidity the PEN orientation is heightened, and crystallization occurs. As a result, the whitening phenomenon occurs and transparency declines, and in addition the mechanical strength declines in the whitened portion. It is thought that in the present invention, through copolymerization of PEN with PET to weaken the crystallinity of PEN, the above-described whitening phenomenon can be adequately suppressed.

Further, the inventors also studied joining members comprising only PET. However, joining members comprising only PET, similarly to joining members comprising only PBT, do not have sufficiently excellent gas barrier properties, and so it was found that the above object of the present invention could not be attained. In a joining member of the present invention, through copolymerization of PET and PEN the gas barrier properties of PET are compensated, and as a result not only is the whitening phenomenon sufficiently suppressed, but the gas barrier properties are sufficiently enhanced. Such a joining member has particularly excellent water vapor barrier properties among gas barrier properties.

In a joining member of the present invention, the high crystallinity inherent in PEN is reduced through copolymerization with PET. Hence mechanical strength is heightened compared with a joining member comprising only PEN. On the other hand, the PET characteristics of susceptibility to degradation due to heating and/or moisture absorption are lessened through copolymerization with PEN, so that splitting with time does not readily occur in a joining member of the present invention. Thus in the present invention a joining member achieves a well-balanced combination of the various required characteristics, and so can be said to be extremely useful as a joining member compared with joining members of the prior art.

The present invention also provides a ballpoint pen comprising an ink accommodating member, a ballpoint pen tip, and a joining member for connecting the ink accommodating member and the ballpoint pen tip; the joining member comprises a resin as a constituent material, and the resin comprises a copolymer of polyethylene terephthalate and polyethylene naphthalate.

A ballpoint pen of the present invention comprises a joining member of the present invention as described above, so that the amount of ink remaining can easily be confirmed, and various designs can be adopted from the standpoint of hues. Further, this ballpoint pen can suppress the degradation of ink accompanying evaporation of moisture in the ink and the intrusion of water vapor and oxygen from the outside air, and in addition can also prevent degradation with time of the joining member accompanying heating and/or moisture absorption. Further, when in a ballpoint pen of the present invention the joining member is press-fit into the inner wall of the ink accommodating tube and connected thereto, the occurrence of cracking and splitting in the joining member can also be suppressed.

In a ballpoint pen of the present invention, the ballpoint pen tip may be of metal. If oxygen from the outside air dissolves in the ink, rust readily occurs on the metal ballpoint pen tip. However, in a ballpoint pen of the present invention, dissolving of oxygen in the ink via the joining member is adequately suppressed, so that the occurrence of rust on the ballpoint pen tip is sufficiently prevented.

When the ballpoint pen tip is made of metal, the ballpoint pen of the present invention may be a water-based ballpoint pen. In this case, rust may occur still more readily on the ballpoint pen tip due to water in the ink and dissolved oxygen from the outside air. In particular, water vapor which has evaporated from within the ink readily accumulates in the connecting portion of the ballpoint pen tip and the joining member, so that if oxygen penetrates the joining member a corrosion reaction occurs, and rust is easily generated. However, in a ballpoint pen of the present invention, the amount of oxygen penetrating the joining member is sufficiently suppressed, so that the occurrence of rust on the ballpoint pen tip is more sufficiently prevented.

Effects of the Invention

By means of the present invention, a joining member, as well as a ballpoint pen comprising such a joining member, can be provided which is sufficiently excellent in both transparency and gas barrier properties in particular.

EXPLANATION OF REFERENCE NUMERALS

Figure 1:
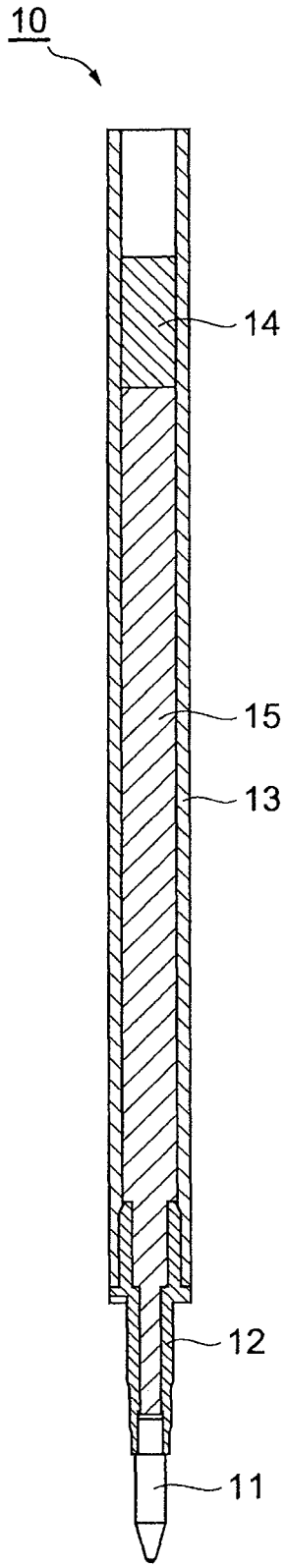
FIG. 1 is a summary cross-sectional view showing the ballpoint pen of a preferred embodiment of the present invention.

10 Ballpoint pen
11 Ballpoint pen tip
12 Joining member
13 Ink accommodating tube
14 Reverse-flow prevention member
15 Water-based ink

BEST MODES FOR CARRYING OUT THE INVENTION

Below, preferred embodiments of the present invention are explained in detail, referring to the drawings as necessary. In the drawings, the same symbols are assigned to the same elements, and redundant explanations are omitted. Further, unless stipulated otherwise, any vertical, lateral, or other positional relationships are based on positional relationships shown in the drawings. Further, dimensional ratios in the drawings are not limited to the ratios shown.

FIG. 1 is a summary cross-sectional view showing a portion of a ballpoint pen of a preferred embodiment of the present invention. However, the portion of the ballpoint pen tip 11, described below, is a front view. This ballpoint pen 10 is a water-based ballpoint pen, comprising a hollow cylinder-shape ink accommodating tube 13, ballpoint pen tip 11, and joining member 12 which connects the ink accommodating tube 13 and the ballpoint pen tip 11. Within the ink accommodating tube 13 on the side of the water-based ink 15 opposite the joining member 12, a reverse-flow prevention member 14 is accommodated in a state adjacent to the water-based ink 15. And, although not shown, a breechblock which prevents leakage of the water-based ink 15 and the reverse-flow prevention member 14 is provided on the end of the ink accommodating tube 13 opposite the joining member 12.

Below, each of the constituent elements of the ballpoint pen 10 is explained; but as constituent elements other than the joining member 12, members generally used in ballpoint pens can be employed.

The water-based ink 15 may be an ordinary water-based ink employing water as a solvent and comprising a dye, pigment, or other colorant, or may be a water-based gel ink. When the water-based ink 15 is a water-based gel ink, various components are comprised to provide shear thinning properties.

As the ink accommodating tube 13, which is an ink accommodating member, a member formed from polypropylene, polyethylene, polyethylene terephthalate, nylon, polyacetal, polycarbonate, or similar can be used. No limitations in particular are imposed on the shape of the ink accommodating tube 14 so long as the shape is a hollow tube; for example, a cylinder shape or similar can be used.

Figure 2:
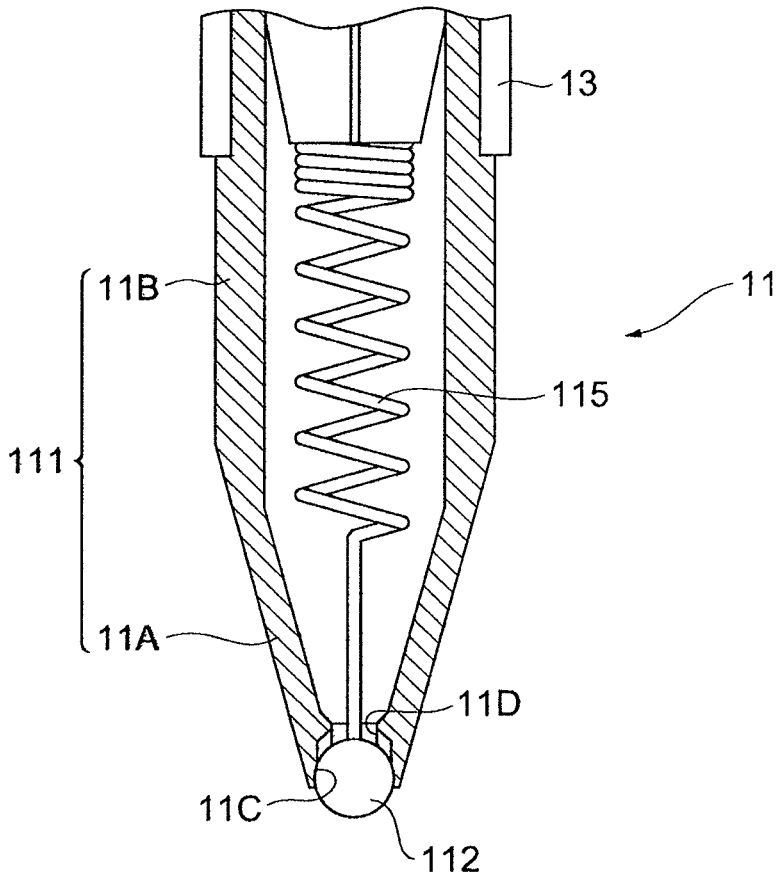
FIG. 2 is a summary cross-sectional view showing the ballpoint pen tip provided in the ballpoint pen of a preferred embodiment of the present invention.

FIG. 2 is a summary cross-sectional view showing the internal structure of the ballpoint pen tip 11. The ballpoint pen tip 11 comprises a taper portion 111, formed with the diameter of the peripheral face of the extremity portion 11A reduced to a taper moving toward the axis, and a cylindrical portion 11B, formed connected with the large-diameter end (rearward) of the taper portion 111, parallel to the axis. In a concavity in the small-diameter end of the taper portion 111 is provided a ball housing 11C into which a transfer ball 112 is inserted; an ink passage 11D is provided penetrating toward the center of the bottom face of this ball housing 11C.

Rearward of the transfer ball 112, an impelling member 115, such as for example a spring, which impels the transfer ball 112 forward, is provided. Through the elastic force of this impelling member 115, the transfer ball 112 is pressed against the inner extremity edge within the ball housing 11C, and prevents ink dripping, intrusion of air, and similar at the tip extremity.

In this embodiment, at least a portion of each of the members forming the ballpoint pen tip 11 is made of metal material. No limitations in particular are placed on the metal material, so long as the material is metal material used in ballpoint pen tips of the prior art; for example, stainless steel may be used.

The joining member 12 has a tube shape, and has a shape such that the water-based ink 15 can flow in the space therewithin. This joining member 12 is connected to the ink accommodating tube 13 by press-fitting one end into the inside of the ink accommodating tube 13. At the other end of the joining member 12, one end of the ballpoint pen tip 11 is press-fitted on the inside thereof, and by this means the joining member 12 is connected to the ballpoint pen tip 11. Connection by these press-fittings prevents leakage of the water-based ink 15 from the connection portions between the joining member 12 and the ink accommodating tube 13 and between the joining member 12 and the ballpoint pen tip 11.

The joining member 12 comprises a resin material. However, a small amount of a component other than a resin material may also be comprised, so long as the advantageous results of the present invention are not impeded. The resin forming the joining member 12 comprises a copolymer of PET having the repeating unit indicated in chemical formula (1) below, and of PEN having the repeating unit indicated in chemical formula (2) below (hereafter called a "PET-PEN copolymer").

[Chemical Formula 1]

(1)

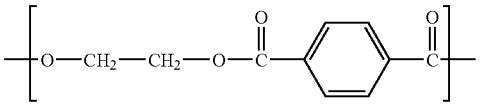

(2)

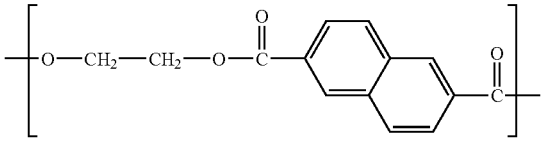

A PET-PEN copolymer can be synthesized by using ordinary methods to heat and cause copolymerization of coexisting PET and PEN. Ordinary PET and PEN materials employed in general injection and extrusion molding can be adopted for use, and commercially marketed products may be obtained. As these commercially marketed products, for example, the PEN material may be the material sold under the product name "Teonex TN8056S" produced by Teijin Chemicals Ltd. The PET material may be for example the materials sold under the product name "PET TR series" produced by Teijin Chemicals Ltd., or the "FR-PET CN series" produced by WinTech Polymer Ltd. One such type may be used independently, or two or more types may be combined.

In this PET-PEN copolymer, no limitations in particular are placed on the molar ratio (PEN/PET) of the repeating units in chemical formula (2) above with respect to the repeating units in chemical formula (1) above, but a ratio of from 1/9 to 4/6 is preferable, and a ratio of from 15/85 to 30/70 is still more preferable. By choosing the molar ratio within these numerical ranges, both the transparency and the gas barrier properties of the joining member 12 can be made well-balanced.

It is preferable that the intrinsic viscosity of the PET-PEN copolymer be from 0.5 to 1.2, and still more preferably from 0.6 to 0.9. If this limiting value is 0.5 or lower, the mechanical strength of the joining member 12 is lowered, and there is a tendency for cracking to occur. And, if the viscosity is high, with an intrinsic viscosity exceeding 1.2, there is a tendency for molding of the joining member 12 to be difficult.

From the standpoint of more reliably manifesting the advantageous results of the present invention, it is preferable that the PET-PEN blending ratio relative to the total quantity of resin forming the joining member 12 be 80 to 100 weight percent. When the joining member 12 comprises a resin other than the PET-PEN copolymer, the resin may be, for example, polybutylene terephthalate, polypropylene, polyethylene, or similar.

The joining member 12 is manufactured by an ordinary resin molding method such as injection molding or extrusion molding. When the joining member is manufactured by injection molding, the state of flow of resin in the mold changes easily. Hence if PEN alone is used as the resin raw material of the joining member, it is thought that in portions in which the flow velocity rises, such as for example portions in which the flow path cross-sectional area is reduced drastically, the PEN crystallizes. As a result, such portions of the joining member are whitened and transparency is reduced, and in addition mechanical strength is lowered. However, in a joining member of the present invention (for example the joining member 12), a PET-PEN copolymer is used as the constituent material, so that the whitening phenomenon in portions in which the flow velocity rises can be sufficiently prevented, and moreover lowering of mechanical strength can also be suppressed. In particular, when a joining member 12 is obtained by injection molding, if the resin raw material is injected into the mold from a pin gate, this advantageous result appears more prominently.

By means of the ballpoint pen 10 of the above-described preferred embodiment of the present invention, by using a PET-PEN copolymer as the constituent material of the joining member 12, the occurrence of a whitening phenomenon in the joining member 12 is suppressed, and sufficiently excellent transparency is obtained. As a result, even when the amount of water-based ink 15 remaining is small, and the liquid surface is on the inside of the joining member 12, the amount of ink remaining can easily be confirmed. Further, by using a PET-PEN copolymer as the constituent material, the mechanical strength of the joining member 12 is made sufficiently high. Hence cracking and splitting can be adequately prevented in the portion of the joining member 12 which is press-fitted into the ink accommodating tube 13 or in the portion which is press-fitted with the ballpoint pen tip 11 in particular.

Further, when at least a portion of the materials of the members constituting the ballpoint pen tip 11 of the ballpoint pen 10 is metal, the occurrence of rust on such metal members can be reduced. In particular, when the ballpoint pen 10 is a non-pressurized type ballpoint pen, this is because intrusion of oxygen from the outside air via the joining member 12 into the water-based ink can be suppressed. The occurrence of rust in the ballpoint pen tip 11 should be particularly prominent at the portion of connection with the joining member 12. This is because water vapor evaporating from the water-based ink 15 accumulates in this connection portion, and together with oxygen causes a corrosion reaction. However, in this ballpoint pen 10 a PET-PEN copolymer is used as the constituent material of the joining member 12, and intrusion of oxygen can be prevented, so that the occurrence of rust in the connection portion can also be adequately suppressed.

When the ballpoint pen 10 is the pressurized type, the water and other volatile components in the water-based ink 15 can be prevented from penetrating the joining member 12 and leaking to the outside, so that the viscosity of the water-based ink 15 does not readily increase.

Further, by adopting a PET-PEN copolymer as the constituent material, moisture absorption of the joining member 12 can also be reduced sufficiently. As a result, compared with a joining member comprising only PET, the occurrence of splitting and cracking which accompany degradation with time of the joining member 12 can be suppressed.

In the above, a preferred embodiment of the present invention has been explained in detail; however, the present invention is not limited to the above embodiment. The present invention can be modified in various ways within a scope not deviating from the gist thereof. For example, a ballpoint pen of the present invention may be an oil-based ballpoint pen, filled with an oil-based ink or an oil-based gel ink in place of the water-based ink 15, or may be a ballpoint pen for use in correction and filled with correction fluid.

Further, in place of a ballpoint pen tip 11 comprising a metal member, a ballpoint pen tip not comprising a metal member may be employed. And, in place of a ballpoint pen tip 11 comprising an impelling member 115, the ballpoint pen may be provided with a ballpoint pen tip not comprising an impelling member. Moreover, a ballpoint pen of the present invention may be a ballpoint pen comprising the ink accommodating tube 13 as a core, and a main body shaft on the outside thereof.

EXAMPLES

Below, the present invention is explained in still more detail using examples; however, the present invention is not limited to these examples.

Comparative Example 1

Figure 3:
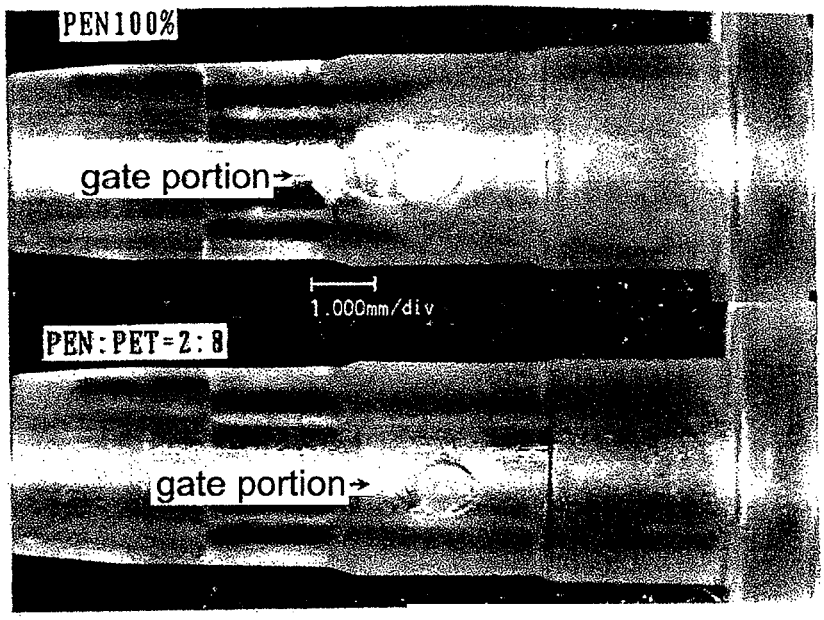
FIG. 3 is a photograph showing a portion of the joining members in a comparative example and in an example of the present invention.
Figure 4:
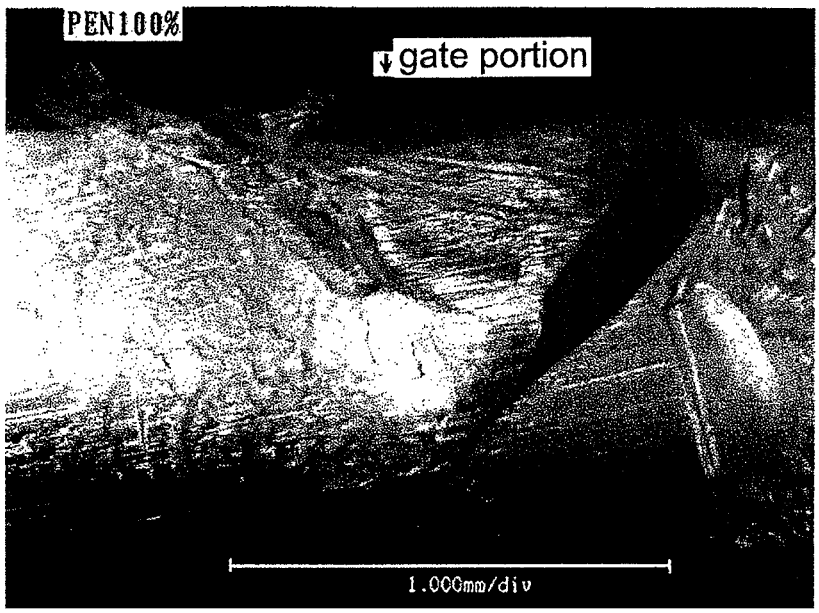
FIG. 4 is a photograph showing a cross-section of a portion of the joining member in a comparative example of the present invention.

A joining member having a cross-sectional shape similar to the cross-sectional shape shown in FIG. 1 was fabricated by ordinary injection molding. PEN was used as the constituent material, and the mold for injection molding used had a pin gate. FIG. 3 shows a photograph of a joining member thus obtained. The joining member shown in the top is the joining member of this comparative example. FIG. 4 shows an enlarged photograph obtained by cutting this joining member so as to pass through the gate portion (the portion equivalent to the pin gate of the mold) and expose the cross-section. From FIG. 4 it was confirmed that cracking occurred in the joining member of this comparative example.

Next, the joining member obtained was used as a constituent member to fabricate a pressurized-type water-based ballpoint pen using ordinary methods. The water-based ballpoint pen obtained had a cross-sectional shape similar to that shown in FIG. 1.

Example 1

Other than using a PET-PEN copolymer (PET: product name "Teonex TN8056S" produced by Teijin Chemicals Ltd.; PEN: product name "TR8580HP" produced by Teijin Chemicals Ltd.; PET/PEN=8/2 (weight ratio)) in place of PEN as the constituent material of the joining member, a joining member was obtained similarly to that of Comparative Example 1. FIG. 3 shows a photograph of the joining member thus obtained. The joining member shown in the bottom is the joining member of this example. From FIG. 3, it was confirmed that compared with the joining member of the above comparative example, whitening in the joining member of this example was largely suppressed.

Figure 5:
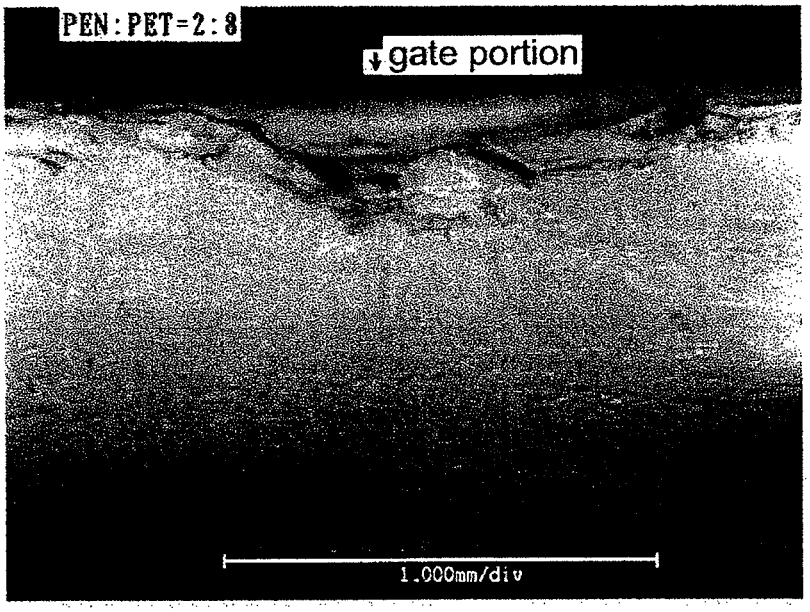
FIG. 5 is a photograph showing a cross-section of a portion of the joining member in an example of the present invention.

FIG. 5 shows an enlarged photograph obtained by cutting this joining member so as to pass through the gate portion. From FIG. 5, it was confirmed that cracking did not occur in the joining member of this example.

Next, the joining member obtained was used as a constituent member to fabricate a pressurized-type water-based ballpoint pen using ordinary methods. The water-based ballpoint pen obtained had a cross-sectional shape similar to that shown in FIG. 1.

[Evaluation of Gas Barrier Properties]

First, ten water-based ballpoint pens in each of Comparative Example 1 and of Example 1 were fabricated as described above. The weight of the water-based ink which filled the pens was measured in advance. Then, the weights of the water-based ballpoint pens obtained were measured. Then the water-based ballpoint pens were left at 60° C. for from two weeks to eight weeks, and upon measuring the weights after two weeks, four weeks, and eight weeks had elapsed, it was found that the weight was decreased in all cases. Assuming that the reduction in weight was due to leakage of volatile gas components from the filled water-based ink to outside the ballpoint pens, the percentage reductions in weight of the water-based ink were calculated. The results as well as the arithmetic averages of the percentage reductions in weight of ten water-based ballpoint pens appear in Table 1.

TABLE 1

| | Comparative Example 1 | | | Example 1 | | |
|---|---|---|---|---|---|---|
| No. | 2 weeks | 4 weeks | 6 weeks | 2 weeks | 4 weeks | 6 weeks |
| 1 | 2.9 | 5.7 | 11.0 | 2.1 | 4.3 | 8.4 |
| 2 | 3.1 | 5.4 | 11.1 | 2.2 | 4.4 | 8.5 |
| 3 | 2.8 | 5.4 | 10.6 | 2.1 | 4.3 | 8.5 |
| 4 | 2.7 | 5.3 | 10.4 | 2.1 | 4.3 | 8.5 |
| 5 | 2.7 | 5.2 | 10.1 | 2.1 | 4.3 | 8.5 |
| 6 | 2.6 | 5.1 | 10.1 | 2.0 | 4.2 | 8.4 |
| 7 | 2.7 | 5.2 | 10.3 | 2.1 | 4.3 | 8.5 |
| 8 | 2.7 | 5.2 | 10.3 | 2.1 | 4.4 | 8.5 |
| 9 | 2.8 | 5.4 | 10.8 | 2.2 | 4.3 | 8.5 |
| 10 | 2.7 | 5.2 | 10.5 | 2.1 | 4.3 | 8.5 |
| Arithmetic average | 2.8 | 5.3 | 10.5 | 2.1 | 4.3 | 8.5 |

INDUSTRIAL APPLICABILITY

By means of the present invention, it is possible to provide a joining member for a ballpoint pen having, in particular, both sufficiently excellent transparency and gas barrier properties, as well as a ballpoint pen comprising such a joining member.

The invention claimed is:

1. A ballpoint pen, comprising an ink accommodating member, a ballpoint pen tip made of metal, and a joining member for connecting the ink accommodating member and the ballpoint pen tip, wherein the ballpoint pen is a water-based ballpoint pen, the joining member comprises a resin as a constituent material, and the resin comprises a copolymer of polyethylene terephthalate and polyethylene naphthalate, wherein a molar ratio of polyethylene naphthalate to polyethylene terephthalate (PEN/PET) in the resin is 1/9 to 4/6.

* * * * *